United States Patent [19]

Heidelberg

[11] Patent Number: 4,516,505

[45] Date of Patent: May 14, 1985

[54] VEHICLE WHICH CAN BE HELD ON A ROADWAY WITH THE AID OF AN ATTRACTING MAGNETIC DEVICE

[76] Inventor: Götz Heidelberg, Am Hügel 16, D-8136 Percha, Fed. Rep. of Germany

[21] Appl. No.: 350,097

[22] Filed: Feb. 18, 1982

[30] Foreign Application Priority Data

Feb. 26, 1981 [DE] Fed. Rep. of Germany ..... 3107341

[51] Int. Cl.[3] ..... B61B 13/08

[52] U.S. Cl. ..... 104/284; 104/281

[58] Field of Search ..... 104/281–284, 104/290, 291, 293, 23 FS; 267/3; 188/43, 44, 195

[56] References Cited

U.S. PATENT DOCUMENTS

| | | | |
|---|---|---|---|
| 3,865,043 | 2/1975 | Schwarzler | 104/281 |
| 3,941,061 | 3/1976 | Schindehutte et al. | 267/3 |
| 4,055,123 | 10/1977 | Heidelberg | 104/284 X |
| 4,142,469 | 3/1979 | Polgreen | 104/284 |
| 4,181,080 | 1/1980 | Miller | 104/281 |
| 4,217,829 | 8/1980 | Heidelberg | 104/281 |
| 4,289,074 | 9/1981 | Nakamura et al. | 104/284 |

FOREIGN PATENT DOCUMENTS

| | | | |
|---|---|---|---|
| 2339060 | 2/1975 | Fed. Rep. of Germany . | |
| 2933447 | 2/1981 | Fed. Rep. of Germany . | |
| 2933446 | 2/1981 | Fed. Rep. of Germany . | |
| 893646 | 12/1981 | U.S.S.R. | 104/293 |

*Primary Examiner*—Randolph Reese

*Attorney, Agent, or Firm*—Spencer & Frank

[57] ABSTRACT

A magnetic levitation vehicle (2) in which the load variations are converted by a coupling device (42) into gap width alterations of an attracting magnetic support device (14). A spring device between the payload carrier (4) and the support component (6) of the vehicle (2) has a sequential arrangement of two spring elements (40; 38) and the coupling device (42) responds only to the deformation of one of the two spring elements.

12 Claims, 3 Drawing Figures

VEHICLE WHICH CAN BE HELD ON A ROADWAY WITH THE AID OF AN ATTRACTING MAGNETIC DEVICE

BACKGROUND OF THE INVENTION

The invention relates to a system operating at least partly by magnetic attraction for maintaining a vehicle in spaced relation to a track or roadway with the aid of an attracting magnetic device which comprises a first part mounted on the track and a second part mounted on the vehicle and lying opposite the first part so as to leave a free gap therebetween.

In a known system of the above type (German Patent Specification No. 2,711,994), the spring device comprises helical springs arranged between the payload carrier and the support part. The coupling means are connected to the payload carrier and are effective between the payload carrier, a support structure of the vehicle part of the magnetic device and the position-defining device. The coupling means determine the load state of the vehicle by the variations of length of the springs.

In this known vehicle, the spring characteristic of the helical springs must be exactly determined, taking into account the lever ratios of the coupling means, with respect to the force-gap width characteristic of the magnet device. Consequently, when determining the vehicle springing, one is restricted to narrow limits.

The invention is based on the problem of providing a vehicle of the type mentioned above in which, despite the above-described necessity of obtaining a particular spring characteristic for the continuous gap width adjustment of the magnetic device, the vehicle springing, as a whole, can be more suitably adapted to prevailing requirements.

SUMMARY OF THE INVENTION

According to the invention an at least partly operating system is provided for maintaining a vehicle in spaced relation to a track. The vehicle includes a support part, a payload carrier, and a spring device joining the support part and the payload carrier, with the payload carrier being movable relative to the support part by deformation of the spring device. The spring device includes at least one spring arrangement having a first spring element and a second spring element sequentially connected with the first spring element. An attracting magnetic device is provided for supporting the vehicle relative to the tract. The magnetic device includes a first part mounted on the track and a second part mounted on the vehicle so as to be opposite the first part and to leave a free gap therebetween. A position-defining device is mounted on the support part for maintaining the support part at a substantially constant spacing from the track. A coupling device is mounted on the support part for continuously detecting a variation of the load of the vehicle exerted on the second spring element and for converting such variation into a gap width adjustment for adjusting the gap between the first and second parts.

The invention thus involves the principle of employing, for the continuous gap width adjustment of the magnetic device, only the length variation of one of two sequential connected spring elements, while one has complete freedom for designing the other spring element. Thus, the other spring element may, for example, be made very weak, which interrupts the conduction of noise to the payload carrier or provided with additional functions, such as level regulation.

The position-defining device can involve, in particular, wheels rollable on the track and/or electromagnets of variable magnetic force and/or components comprising at least one electromagnet and at least one wheel.

When electromagnets are employed as the position-defining device, the latter is normally regulated with the help of a gap width sensor by alteration of the current strength flowing therethrough to substantially constant gap widths relative to the corresponding track zones, so that the position-defining device is guided at a substantially constant spacing relative to the track. In the case of wheels, such a regulation is superfluous, so that the wheel axes, without further auxiliary measures, are guided at a constant spacing relative to the track. The phrase "guided at a substantially constant spacing relative to the track" should thus also include the case of accurately constant spacing, for example of wheel axes, relative to the track and the case of the wheel periphery rolling on the track. The coupling means, which suitably are force-transmitting, can involve in particular mechanical or hydraulic connecting links. The coupling means are advantageously so designed that the gap width variations induced thereby are smaller than the deformation strokes undergone by the spring device. The attracting magnetic device is advantageously made with permanent magnets on the vehicle part and laminated ferrromagnetic components on the track part. Advantageously, the magnetic device also provides, in addition to the supporting forces, the propulsion forces for the vehicle, in accordance with German Patent Specification No. 2,339,060. By supporting the vehicle relative to the track is meant substantially vertical support against gravity and, in appropriate occasions, inertia forces, as well as disturbance forces, and/or substantially horizontal support, for example against inertia forces during travel around curves or disturbance forces, such as wind forces, and/or support against any other forces which could displace the vehicle from the intended relative position with repsect to the track. The position-defining device serves, so to say, as an aid for the coupling means in order to be able to bring the vehicle component of the magnetic device closer to the track component or to displace it from the track component. In carrying out this function, force variation effects normally occur between the position-defining device and the track, which are added to the support force balance of the vehicle, so that the position-defining device can also be referred to as an auxiliary force device. The adjustment of the gap width of the magnetic device with the help of the coupling means has the meaning of adapting the support force provided by the magnetic device as well as possible to the magnitude of the required support force. Detailed explanations with respect to the above-mentioned points are given in German Patent Specification No. 2,339,060 and German Patent Specification No. 2,711,994 and the content of these patent specifications is specifically incorporated by reference as a part of the disclosure in the present application.

In a vehicle according to the present invention, there are advantageously provided a plurality of sequential arrangements, of a first spring element and a second spring element; the arrangement in pairs of two such sequential arrangements is particularly preferred, one being associated with the left-hand side of the vehicle, with respect to the direction of travel, and the other with the right-hand side of the vehicle, with respect to the direction of travel. A plurality of such pairs can be provided along the vehicle. The provision of two bogie-like support components along the vehicle and the provision of a pair of sequential arrangements for each bogie-like support component is particularly favorable.

A particularly advantageous connection position for the coupling means is the region between the two spring elements, so that the load condition of the vehicle is detected at the spring element spaced from the payload carrier in the direction of the spring force.

Advantageously, the spring element at which the load condition of the vehicle is not detected is constructed as a pneumatic spring element, for example in the form of a gas-or air-filled spring bellows. With such a spring element, the amount of the contained gas or air amount can be made variable, whereby for example an increase in the amount can be effected by pumping and a reduction in the amount can be effected by a controlled release or pumping to a different space. In this way, the pneumatic spring element or pneumatic spring elements provided in pairs can be utilized for level adjustment or regulation of the payload carrier and/or for desired inclination of the payload carrier about a rolling axis, extending in the longitudinal direction of the vehicle, during travel around a curve. That is to say, it has been found that it is very difficult to construct the track so that it is raised at the outer side of the curves for a vehicle supported by means of a magnetic device, since the track must be very accurately adjusted. The problems increase when there are two tracks for passing vehicles or switches in the curves. By the invention, a simple possibility is obtained from the point of view of construction, of being able to construct the track without raised curves and consequently of adjusting the vehicle in curves at an inclination relative to the track, which is advantageous for the comfort of the passengers. By the invention, additional functions of the spring device, such as level adjustment and inclination of the payload carrier during travel around curves, are available without the coupling means being affected thereby, so that the desired adaptation of the gap width of the magnetic device to the required suspension force can be effected as before and without being influenced.

Further aspects of the invention are particularly suitable for special space requirements arising from need for space or from adaptation to magnetically suspended vehicles. An arrangement of the first spring elements to the left and the right, as far outwardly as possible on the payload carrier, is advantageous in the interest of stabilization with respect to rolling movements of the payload carrier. The first spring element can suitably have a low height, which is advantageous with respect to the total vehicle height and the investment costs for tunnel construction. The second spring elements can advantageously be arranged to the left and the right further inwardly on the vehicle, where sufficient space is available. The coupling means are advantageously provided in pairs for the left-hand and right-hand sides of the vehicle.

By the vehicle according to the invention, the principle that the raising and lowering of the side regions of the payload carrier relative to the track, caused by rolling movement, produce different gap width variations as compared to raising and lowering of the payload carrier relative to the track caused by translational movements can be utilized. More detailed disclosures in this connection are provided in the description of a preferred embodiment further herebelow and in German Published Specification No. 2933447, the content of which is expressly made part of the disclosure of the present application by reference.

If the vehicle according to the invention is equipped with a brake device, then it is advantageous to arrange the brake device on the support part in such a way that it is substantially constant in position relative to the track, and thus always maintained in substantially the same relative position relative to the track independently of the load condition of the vehicle, of the state of deformation of the spring device and of the position of the vehicle part of the magnetic device relative to the track, so that on braking the brake travel of the brake blocks remains substantially uniform and also, in the case of multiple brake blocks engaging the track, remains substantially equal from one block to the other. The simplest possibility for embodying this comprises applying the brake device to the position-defining device, which already has a substantially constant position relative to the track. When, in particular, there is not sufficent space available there, a further possibility comprises arranging the brake device on a support structure of the vehicle part of the magnetic device and, by brake device coupling means, effecting such an equalization that the brake device remains in a substantially constant position relative to the track despite the support structure of the vehicle component of the magnetic device not remaining in a constant position relative to the track.

Preferably, the vehicle according to the invention has a spring-loaded brake device. In this spring-loaded brake device, a piston and cylinder unit acting in opposition to the spring-load can be provided, the rest pressure of which is adjustable by a pressure reduction valve. In this way it can be ensured that, for example, during low loading of the payload carrier it is ensured that the brake block pressure forces exerted by the spring-load are smaller and vice versa.

BRIEF DESCRIPTION OF THE DRAWINGS

The invention and developments of the invention are explained in greater detail below with reference to an embodiment partly diagrammatically illustrated in the drawing, in which.

DESCRIPTION OF THE PREFERRED EMBODIMENTS

Figure 1:
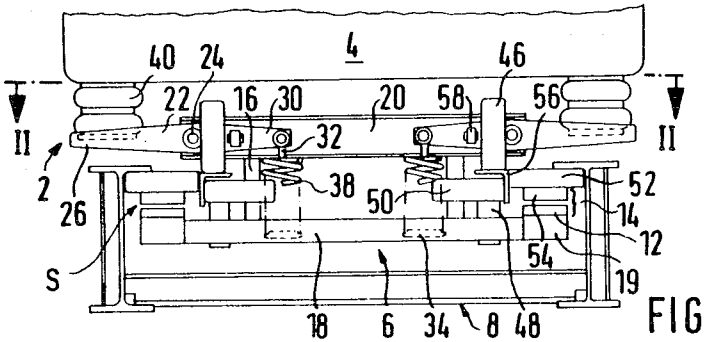
FIG. 1 shows a front elevational view of the vehicle according to I—I in FIG. 2, only a part of the payload carrier being diagrammatically represented.

The vehicle 2 has a payload carrier 4, for example, in the form of a passenger cabin, and a support part 6. In FIG. 1, furthermore, the track can be seen in cross-section, while the track 8 is omitted from FIG. 2 for reasons of clarity.

The entire support part 6 of the vehicle 2 comprises two bogie-like components, one of which is arranged in the vicinity of the front end of the vehicle 2 and one of which is arranged in the vicinity of the rear end of the vehicle 2.

Figure 2:
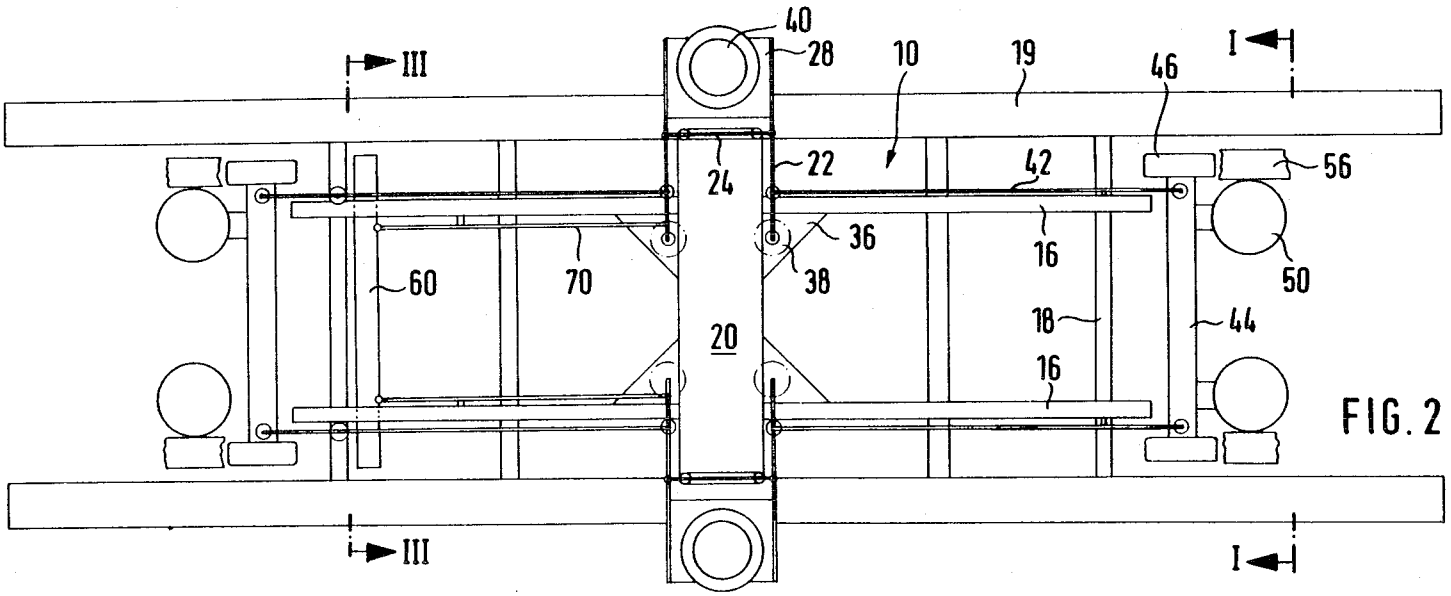
FIG. 2 shows a plan view of the support part of the vehicle according to II—II in FIG. 1.

In FIG. 2, one of these bogie-like components is illustrated. The two bogie-like components are similarly constructed, so that only one is described hereinafter.

Each bogie-like component comprises, essentially, a support structure 10 for the vehicle part of the magnetic device 14. The support structure 10 comprises essentially two longitudinal beams 16, a series of transverse beams 18 distributed along the longitudinal beams 16, which transverse beams 18 are fixed to the undersides of the longitudinal beams 16 and project at both sides outwardly beyond the longitudinal beams 16, two further longitudinal beams 19, which are each connected to the free ends of the transverse beams 18, and a transverse crossbeam 20 which, with respect to the longitudinal direction of the vehicle 2, extends at right angles to the longitudinal beams 16 at midpoints of the longitudinal beams 16 and is arranged parallel to the transverse beams 18. The transverse crossbeam 20 is fixed to the tops of the longitudinal beams 16 and projects outwardly beyond these at both sides.

At each free outer end of the transverse crossbeam 20, two transverse levers or beams 22 are supported rotatable about an axis defined by axle 24 extending in the longitudinal direction of the vehicle and, more particularly, one transverse lever 22 is mounted before the transverse crossbeam 20 in the longitudinal direction of the vehicle. The two transverse levers 22 at each side of the vehicle are connected together at the end regions of their outer arms 26 by a horizontal plate 28 and thus together functionally constitute a (common) transverse lever 22. From the inner arm 30 of each transverse lever 22, a rod 32 extends downwardly, which is fixedly connected at the bottom with a horizontal plate or disk 34. Between the respective plate 34 and respective triangular plate 36, which is fixed to the position at which the transverse crossbar 20 crosses the respective longitudinal beam 16, there is arranged a respective helical spring 38. A compressed air-filled spring bellows 40 bears on the plate 28 at the outer arm 26 of each transverse lever pair 22. The payload carrier 4 rests on top of the two spring bellows 44.

Furthermore, by the spring bellows 40 the payload carrier 4 is connected with the support part 6 or the two bogie-like components of the support part 6 through links, which are not illustrated, and/or through a vertical pin, which is not illustrated and which, with respect to the transverse direction of the vehicle, extends through the middle of the transverse crossbeam 20. Each bogie-like component of the support part 6 is symmetrical with respect to a plane extending in the longitudinal direction of the vehicle, through the middle of the transverse beams 18.

On loading of the payload carrier 4 relative to the support part 6, the spring bellows 40 are compressed and the helical springs 38, due to the action of the respective rods 32, are compressed between the respective plate 34 and the respective plates 36. At each side of the vehicle, the parallel arrangement of two helical springs 38 represents, functionally, one (common) helical spring element. Thus, at each side of the vehicle there is provided a sequential arrangement of a first spring element in the form of a spring bellows 40 and a second spring element in the form of two helical springs 38 connected in parallel.

From each (individual) transverse lever 22 a longitudinal lever 42 extends, closely outside the respective longitudinal beam 16, forwardly and rearwardly in the longitudinal direction of the vehicle. Each longitudinal lever 42 is linked to the associated (individual) transverse lever 22 in the region between the axle 24 and the point of connection of the rod 32. Each longitudinal lever 42 is, furthermore, pivoted so as to be swingable about a horizontal axis on the associated longitudinal beam 16 at the end region thereof. The pivotal connection of each lever 42 to beam 16 is denoted in FIG. 2 by two vertical lines near the free end of each respective beam 16 (i.e. in the vicinity of the respective outer transverse beam 18). The front ends of the two longitudinal levers 42, which extend forwardly from the transverse lever 22 lying before the transverse crossbeam 20 in the longitudinal direction of the vehicle, are pivotally connected to a support body 44 extending transversely of the longitudinal direction of the vehicle. The same holds true for the two longitudinal levers 42 extending rearwardly from the transverse levers 22 arranged behind the transverse crossbeam 20 and for the four longitudinal levers 42 of the other bogie-like component of the support part 6. Thus, a support body 44 is provided at the front and rear ends of each bogie-like component, i.e. a total of four support bodies 44 are provided for the entire support part 6. The support bodies 44 are located, respectively, before or behind the ends of the longitudinal beams 16.

Each support body 44 carries, at the left and the right, a respective upper wheel 46 having a horizontal axis, a lower wheel having a horizontal axis and a lateral guidance wheel 50 having a vertical axis. The four support bodies 44 with six respective wheels together represent the position-defining device on the support part 6.

The track 8, which is constructed from steel beams, has a substantially U-shaped cross-section, the open sides of the U extending upwardly and a beam 52 projecting inwardly from the vertical web of the U, at the top, along the track 8. At the underside of each beam 52, there is disposed a stator 54, of ferromagnetic material, composed of upright laminated plates extending longitudinally. The stator 54 has transversely extending grooves, which are not illustrated, and in which a travelling field winding, for example three phase, is laid in meander form. Opposite each stator 54, at the top of the support structure 10, there is fixed a series of permanent magnets 12, shown in FIG. 1, the longitudinal center spacing of which (i.e. the spacing from the center of one permanent magnet to the center of an adjacent permanent magnet) corresponds to three times the center spacing of two adjacent stator teeth formed, respectively, between two transverse grooves. Adjacent permanent magnets have respective reverse polarities. Thus, by the respective stator 54 with the inserted travelling field winding and the opposed series of magnets extending in the longitudinal direction, there is formed a magnetic device 14, which simultaneously exerts by attraction support or suspension forces and also propulsion forces on the vehicle 2. Also, the track 8 is symmetrical with respect to a vertical longitudinal plane through its center.

At the inner edge of each beam 52, a longitudinally extending angle beam 56 is fixed by its vertical web, the horizontal web projecting inwardly, The horizontal web of each angle beam 56 serves, at its lower side, as a rolling surface for the lower wheels 48. The inner surface of the vertical web of each angle beam 56 serves as a rolling surface for the lateral guidance wheels 50.

The support part 6 or each bogie-like component of the support part 6 has, in cross-section, speaking generally, a double T-shape form of which the upper flange, provided by the transverse lever 22, projects laterally outwardly beyond the angle beam 56 and the beams 52, the middle region of which, formed by the longitudinal beam 16 extends between the two angle beams 56 and the lower flange of which, formed by the transverse beams 18, extends at both sides outwardly to beneath the beams 52 and the opposite stators 54. The helical springs 38 are arranged closely beneath the respective longitudinal beams 16.

Since the wheels 46, 48 and 50 permanently roll on the angle beams 56, the position-defining device 44, 46, 48 and 50 is entirely guided at a constant position on the track 8 and thus represents the fixed point of the entire system. When the payload carrier 4 sinks uniformly at the left and the right through a certain amount relative to the track 8, for example, due to the boarding of passengers, the outer arms 26 of the transverse lever 22 are lowered and the inner arms 30 of the transverse levers 22 are raised.

In addition, the connection points 58 of the longitudinal levers 42 are raised, although through a somewhat shorter distance, since these connection points 58 lie closer to the respective shafts 24 than the middle points of the plates 36. The longitudinal levers 42, raised at their points of connection 58 at the transverse levers 22, swing about their connection positions on the support bodies 44, since these are constantly positioned. The longitudinal levers 42, due to their pivotal connection to the longitudinal beams 16, carry the support structure 10 and the permanent magnets provided thereon upwardly. Consequently, the gap width s of the magnetic device 14 is reduced. The respective lever arm length ratio of the longitudinal levers 42, i.e. the spacing between the connection positions on the transverse levers 22 and the connection positions on the carrier bodies 44, relative to the spacing between the connection positions on the longitudinal carrier 16 and the connection positions on the support bodies 44 amounts to about 5:1, so that the path of pivoting occuring at the connection point 58 is converted, with a path reduction in the ratio 5:1, into a gap width reduction in the magnetic device 14. With respect to further details of this gap width alteration in dependence on the load condition of the payload carrier 4, reference is specifically made to German Patent Specification No. 2711994.

The longitudinal levers 42, with their pivots on the transverse levers 22, their support structure 10 and the support bodies 44 of the position-defining device, together constitute coupling means which adjust the gap width s of the attracting magnetic device 14 in dependence on the load condition of the vehicle 2 in such a way that, upon a load increase, a reduction of the gap width s is obtained and vice versa. In this way, it is ensured that the magnetic device 14 always applies the vast majority of the total required holding or supporting force, while the wheels 46, 48 need to apply only a small residual force portion. The pivoting of the longitudinal lever 42 depends only on the pivotal position of the transverse lever 22, and thus on deformation of the helical springs 38.

Deformation of only the spring bellows 40 does not result in the pivoting of the transverse levers 22 and, thus, not to the pivoting of the longitudinal lever 42. A length alteration of the spring bellows 40 alone in the vertical direction can, for example, be produced by pumping in additional amounts of air or by the release of amounts of air. This is effected, for example, during level adjustment or regulation of the payload carrier 4 in order, for example, to support the payload carrier 4 at a uniform height relative to platforms independently of the number of persons being conveyed. A further possibility, during travel around curves, comprises pumping amounts of air from the spring bellows 40 at the inner side of the curve to the spring bellows 40 at the outer side of the curve by means of a pump device, which is not illustrated. In this way, the payload carrier 4 can be adjusted at an inclination about a roll axis, extending longitudinally of the vehicle, relative to the support component 6 and relative to the track 8, even when the track 8 or, more accurately stated, the two stators 58 remain horizontally disposed. This pumping can be controlled by suitable sensors, which for example detect the pivoting of the bogie-like components of the support part 6 during travel around a curve. By the sequential arrangement according to the invention of spring elements, i.e. a spring bellows 40 and a parallel arrangement of two helical springs 38, which is to be considered as a functional unit, at each side of the vehicle and each bogie-like compenent, it is ensured that one can manipulate in any way with one spring element, i.e. the spring cushion 40, without the second spring element, i.e. the respective associated helical springs 38, thereby being deformed. Sprung displacements of the payload carrier 4 due to varying loading cause a deformation of both the spring bellows 40 and also the helical springs 38 and it is fully sufficient for the coupling means 42 to detect only the state of deformation of the repective second spring elements.

For the sake of clarity, in FIG. 1 the support body 44, on which the wheels 46, 48 and 50 are journaled, is not illustrated.

If, for example, by boarding persons the transverse lever outer ends are each lowered by 6 cm., there is produced, due to the above-described lever length ratio at the transverse levers 22 and at the longitudinal levers 42, for example, a reduction of the gap width s by 1 cm. When, on the other hand, for example due to unsymmetrical left hand and right hand distribution of persons in the payload carrier 4, the left transverse lever outer side moves downwardly through 6 cm. and the right transverse lever outer side moves upwardly throught 6 cm., there is produced at the left side of the vehicle a gap width reduction of about 1.5 cm. and on the right side of the vehicle a gap width enlargement of about 1.5 cm. since, as viewed in the front elevation of the vehicle 2, the spacing of the middle of the magnetic device 14 on the respective vehicle side relative to the vehicle center is about 1.5 times as large as the spacing from the point of pivoting of the respective longitudinal lever 42 on the support structure from the middle of the vehicle. This is advantageous, since the two sides of the magnetic device 14 are located further inwardly than the outer sides of the payload carrier 4 and consequently such an inclined position of the payload carrier 4, required by rolling movement, must be taken up at the smaller lever arm of the magentic device 14. For further details on this principle, reference is expressly made to German Published Specification No. 2933447. The above-described holds true, of course, only for the inclined position of the payload carrier 4, caused by rolling movement, due to unsymmetrical loading of the payload carrie 4, but not, however, for intended inclinations with the help of different air amounts in the left and right hand spring bellows 40, since the longitudinal levers 42 are not at all affected thereby.

Figure 3:
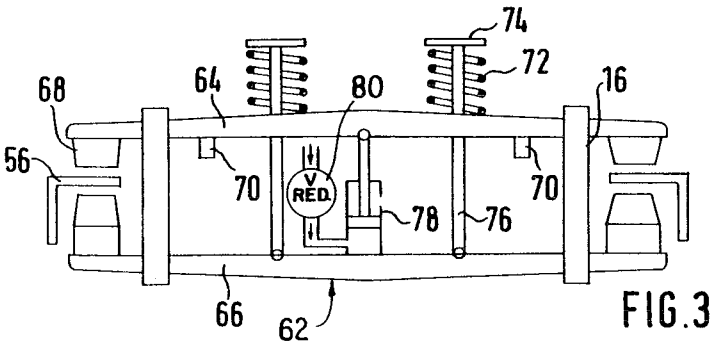
FIG. 3 shows a front elevational view of a brake device according to III—III of FIG. 2.

A brake device 60 is illustrated diagrammatically in FIG. 2 and in detail in FIG. 3. The brake device 60 comprises essentially a support body 62, including in upper brake arm 64 and a lower brake arm 66, which each extend transversely of the vehicle longitudinal direction and carry brake blocks 68 at their ends. The brake blocks of the upper brake arm 64 co-operate, during braking, with the upper sides of the horizontal webs of the angle beam 56 and the brake blocks of the lower brake arms 66 co-operate, during braking, with the undersides of the horizontal webs of the angle beams 56. The brake body 62 is pivotally connected to two brake device longitudinal levers 70, which each extend closely within the longitudinal beams 16 to the respective lever arm 22. The brake device longitudinal levers 70 are, furthermore, pivotally connected at a point, which lies substantially closer to the brake device 60 than to the associated transverse lever 22, to the respective longitudinal beams 16. The pivotal connection of levers 70 to the respective beams 16 is denoted in FIG. 2 by two small vertical lines between each lever 70 and the associated beam 16 just to the left of center of each such beam 16. The brake device 60 is located, as a whole, relatively close to a support body 44. When, for example, the payload carrier 4 is lowered by an increase in the load and, consequently, as described, the support structure 10 and therewith also the longitudinal beams 16 are raised by a lesser distance, the pivot positions of the brake device longitudinal lever 70 are raised therewith. However, the pivot positions of the brake device longitudinal lever 70 on the transverse levers 22 are raised by substantially greater amount. There is thus produced altogether a lowering of the brake device 60 relative to the longitudinal beams 16. The lever ratios are so selected that this lowering of the brake device 60 just compensates the raising of the support structure 10 and the longitudinal beams 16, so that the relative position of the brake device 60 with respect to the track 8 or, more accurately stated, with respect to the angle beams 56 remains constant. The same holds true, analogously, for the raising of the payload carrier 4 relative to the track, for example upon unloading by persons dismounting.

The two brake arms 64, 66 are preloaded towards one another by two compression springs 72, which are arranged on the upper brake arm 64 and connected with the lower brake arms 66 through disks 74, arranged at the top on the compression springs 72, and rods 76 extending from the disks 74 to the lower brake arms 66. Between the two brake arms 64, 66, there is arranged a piston and cylinder unit 78, which acts to press together the two brake arms 64, 66. By a pressure reduction valve 80 the residual pressure which remains in the piston and cylinder unit 78 after release of the brake device can be determined by pressure release. If a stronger braking force is desired, for example when the vehicle 2 is fully loaded, the rest position is adjusted lower by means of the pressure reduction valve, and vice versa. This adjustment can, for example, be effected with the help of one of the transverse levers 22, which reflects the load condition of the vehicle 2.

I claim:

1. A system operating at least partly by magnetic attraction for maintaining a vehicle in spaced relation to a track, said system comprising:

a track, a vehicle, said vehicle including a support part, a payload carrier, and spring means joining said support part and said payload carrier, said payload carrier being movable relative to said support part by deformation of said spring means and said spring means including at least one spring arrangement having a first spring element and a second spring element sequentially connected with said first spring element;

attracting magnetic means for providing a magnetic force and for supporting said vehicle relative to said track, said attracting magnetic means including a first part mounted on said track and a second part mounted on the support part of said vehicle so as to be opposite said first part and to leave a free gap therebetween;

position-defining means mounted on said support part and guided at a substantially constant spacing from said track; and coupling means mounted on said support part for providing a connection between said position-defining means and said second spring element for continuously detecting a variation of the load of said vehicle exerted on said second spring element and for converting such variation into a shift of said support part relative to said position-defining means thereby altering the width of said gap between said first and second parts for varying the magnetic force of said magnetic means and adapting such force to the load of said vehicle.

2. A system according to claim 1, wherein said first spring element is a pneumatic spring element.

3. A system according to claim 2, wherein said pneumatic spring element contains gas and the amount of gas contained in said pneumatic spring element is variable.

4. A system according to claim 1, wherein said vehicle has a vertical plane extending through a longitudinal mid-line of said vehicle and dividing said vehicle into first and second half portions, said at least one spring arrangement includes a first said spring arrangement associated with said first half portion and a second said spring arrangement associated with said second half portion, and each said spring arrangement includes a transverse lever extending transversely to the mid-line of said vehicle and having an outer arm journaled on said support part and extending outwardly of said vehicle and an inner arm extending inwardly of said vehicle, with the first spring element of said spring arrangement being arranged between said payload carrier and said outer arm and the second spring element of said spring arrangement being operatively connected with said inner arm.

5. A system according to claim 4, wherein each said spring arrangement includes a disk and a rod connecting said disk to said inner arm, with said second spring element having an upper end supported on said support part and a lower end which is supported by said disk.

6. A system according to claim 4, wherein said position-defining means comprises a beam mounted to and extending longitudinally of said track and wheels mounted on said support part and cooperating with said beam.

7. A system according to claim 1, wherein said attracting magnetic means includes supporting structure for supporting said second part, said spring means includes connecting means for connecting said first spring element to said second spring element, and said coupling means includes at least one longitudinal lever extending in the longitudinal direction of said vehicle, said longitudinal lever being connected to said position defining means, said support structure and said connecting means.

8. A system according to claim 1, and further including brake means for braking said vehicle, said brake means being mounted on said support part and arranged at a substantially constant position with respect to said track.

9. A system according to claim 8, wherein said attracting magnetic means includes supporting structure for supporting said second part, said spring means includes connecting means for connecting said first spring element to said second spring element, and further including a brake coupling means operatively connected with said brake means, said support structure and said connecting means for effecting the constant positioning of said brake means.

10. A system according to claim 9, wherein said position-defining means comprises a beam mounted to and extending longitudinally of said track and wheels mounted on said support part and cooperating with said beam.

11. A system according to claim 8, wherein said brake means comprises a spring-loaded braking device including a pre-loaded spring and a piston and cylinder unit pressing against said preloaded spring, said unit including a pressure reduction valve for adjusting the rest pressure of said unit.

12. A system according to claim 1, wherein said position-defining means comprises a beam mounted to and extending longitudinally of said track and wheels mounted on said support part and cooperating with said beam.

* * * * *